US007104464B2

(12) United States Patent
Kobayashi et al.

(10) Patent No.: US 7,104,464 B2
(45) Date of Patent: Sep. 12, 2006

(54) FUEL SUPPLY METHOD AND FUEL SUPPLY SYSTEM

(75) Inventors: Masayoshi Kobayashi, Kobe (JP); Hiroyuki Ninomiya, Akashi (JP); Hiroaki Miyamoto, Akashi (JP); Takeo Oda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 159 days.

(21) Appl. No.: 10/809,692

(22) Filed: Mar. 26, 2004

(65) Prior Publication Data

US 2005/0139694 A1 Jun. 30, 2005

(30) Foreign Application Priority Data

Dec. 25, 2003 (JP) ..... 2003-430408
Jan. 21, 2004 (JP) ..... 2004-012585

(51) Int. Cl.

| | |
|---|---|
| ***F02D 1/06*** | (2006.01) |
| ***F02M 47/02*** | (2006.01) |
| ***F02M 45/10*** | (2006.01) |
| ***F02M 59/00*** | (2006.01) |
| ***F02M 39/00*** | (2006.01) |
| ***B05B 1/30*** | (2006.01) |

(52) U.S. Cl. ..... 239/5; 239/88; 239/89; 239/90; 239/91; 239/92; 239/93; 239/94; 239/95; 239/533.2; 239/533.3; 239/585.1; 239/585.3; 239/585.4

(58) Field of Classification Search ..... 239/5, 239/88–95, 533.2, 533.3, 585.1, 585.3, 585.4, 239/585.5, 290, 416.4, 422, 424.5
See application file for complete search history.

(56) References Cited

U.S. PATENT DOCUMENTS

| | | | | |
|---|---|---|---|---|
| 3,674,245 | A * | 7/1972 | Massarotti | 261/28 |
| 3,684,186 | A | 8/1972 | Helmrich | |
| 3,912,164 | A | 10/1975 | Lefebvre et al. | |
| 5,577,386 | A | 11/1996 | Alary et al. | |
| 6,082,113 | A | 7/2000 | Prociw et al. | |
| 6,484,489 | B1 | 11/2002 | Foust et al. | |

FOREIGN PATENT DOCUMENTS

| | | |
|---|---|---|
| EP | 1 369 644 A1 | 12/2003 |
| JP | A 2003-4231 | 1/2003 |

* cited by examiner

*Primary Examiner*—Davis Hwu
(74) *Attorney, Agent, or Firm*—Oliff & Berridge, PLC

(57) ABSTRACT

A fuel supply method for a fuel injection device including a fuel injection unit, comprising: supplying fuel to a first fuel injection member of the fuel injection unit through a first fuel supply passage internally formed in a holding-and-supplying unit holding the fuel injection unit; and supplying fuel to a second fuel injection member of the fuel injection unit through a second fuel supply passage internally formed in the holding-and-supplying unit.

5 Claims, 3 Drawing Sheets

FUEL SUPPLY METHOD AND FUEL SUPPLY SYSTEM

BACKGROUND OF THE INVENTION

1. Technical Field

The present invention relates to a fuel supply method and a fuel supply system and, more specifically, to a fuel supply method and fuel supply system for supplying fuel in a fuel injection device of a gas turbine so as to achieve low-$NO_x$ operation.

2. Description of the Related Art

There has been a demand in recent years for a fuel injection nozzle for combustors, capable of injecting fuel such that the exhaust gas has a low $NO_x$ concentration, owing to the recent progressively growing severity of controls concerning $NO_x$ emission imposed on aero and industrial combustors. To achieve low-$NO_x$ combustion, the fuel injection nozzle is required to inject fuel such that the mean flame temperature is low and temperature distribution in flames is uniform. Fuel must be mixed with a large amount of air to lower the mean flame temperature and to make temperature distribution in flames uniform.

When fuel is jetted by a conventional fuel injection nozzle N having a single fuel passage 101 as shown in FIG. 3, the fuel is mixed in a large amount of air for low-$NO_x$ combustion, the spatial distribution of the fuel is liable to occur, and flame temperature is distributed. Such a mode of combustion is undesirable to reduce $NO_x$ emission. Although no problem arises in combustion while the combustor is operating in a high power setting, the air-fuel mixture becomes excessively lean and combustion becomes unstable while the combustor is operating in a low-power or middle-power settings.

Unstable combustion that occurs in the low-power setting or middle-power setting may be avoided by an improved fuel injection nozzle obtained by altering the conventional fuel injection nozzle N. The improved fuel injection nozzle has a plurality of series of swirl vanes which are concentrically arranged in different radial positions, and a plurality of series of fuel injection mechanisms which are concentrically arranged in different radial positions. The operation of the fuel injection mechanisms is regulated according to engine power settings, and the amount of air into which the fuel is mixed is regulated for the so-called staging combustion. A fuel injection device provided with such fuel injection mechanisms is under development.

When the plurality of fuel injection mechanisms in different radial positions are used for staging combustion, problems arises in holding the fuel injection mechanisms and in a method of supplying fuel to the fuel injection mechanisms.

For example, if the fuel injection mechanisms are held individually on holding arms and the fuel is supplied through the arms, blockage of the air flow into combustor increases, and the air flowing into a fuel injection unit will be distorted. There is the possibility that joints of the fuel injection mechanisms and the arms are damaged due to difference in thermal expansion between the fuel injection mechanisms and the arms.

SUMMARY OF THE INVENTION

The present invention has been made in view of such problems in the related art and it is therefore an object of the present invention to provide a fuel supply method and a fuel supply system for a fuel injection device for staging combustion or to a fuel injection device provided with a plurality of fuel injection mechanisms at different radial positions.

According to a first aspect of the present invention, a fuel supply method for a fuel injection device including a fuel injection unit and a holding-and-supplying unit holding the fuel injection unit, the fuel injection unit including a first fuel injection member, a first atomizing mechanism surrounding the first fuel injection member, a second fuel injection unit disposed radially outside the first atomizing mechanism, a second atomizing mechanism disposed radially outside the second fuel injection member, and an outer casing surrounding the second atomizing mechanism, comprises: supplying fuel to the first fuel injection member through a first fuel supply passage internally formed in the holding-and-supplying unit; and supplying fuel to the second fuel injection member through a second fuel supply passage internally formed in the holding-and-supplying unit.

Preferably, the first fuel supply passage and the second fuel supply passage are arranged so as to overlap each other with respect to a flowing direction of combustion air.

According to a second aspect of the present invention, in a fuel supply system for a fuel injection device including a fuel injection unit and a holding-and-supplying unit holding the fuel injection unit, the fuel injection unit including a first fuel injection member, a first atomizing mechanism surrounding the first fuel injection member, a second fuel injection member disposed radially outside the first atomizing mechanism, a second atomizing mechanism disposed radially outside the second fuel injection member, and an outer casing surrounding the second atomizing mechanism, the holding-and-supplying unit is internally provided with a first fuel supply passage through which fuel is supplied to the first fuel injection member and a second fuel supply passage through which fuel is supplied to the second fuel injection member.

Preferably, the first fuel supply passage and the second fuel supply passage are arranged so as to overlap each other with respect to a flowing direction of combustion air.

Preferably, the holding-and-supplying unit includes an integral assembly of an outer ring joined to the outer casing, an inner ring joined to the second fuel injection member, a cylindrical part joined to the first fuel injection member, and a fuel feed arm joined to the outer ring, and air passages are formed between the outer ring and the inner ring and between the inner ring and the cylindrical part.

According to the present invention, fuel can be supplied to the fuel injection device including the fuel injection unit without causing troubles attributable to the increase of blockage of the air flow into combustor and the difference in thermal expansion between the connected parts.

DESCRIPTION OF THE PREFERRED EMBODIMENTS

Figure 1:
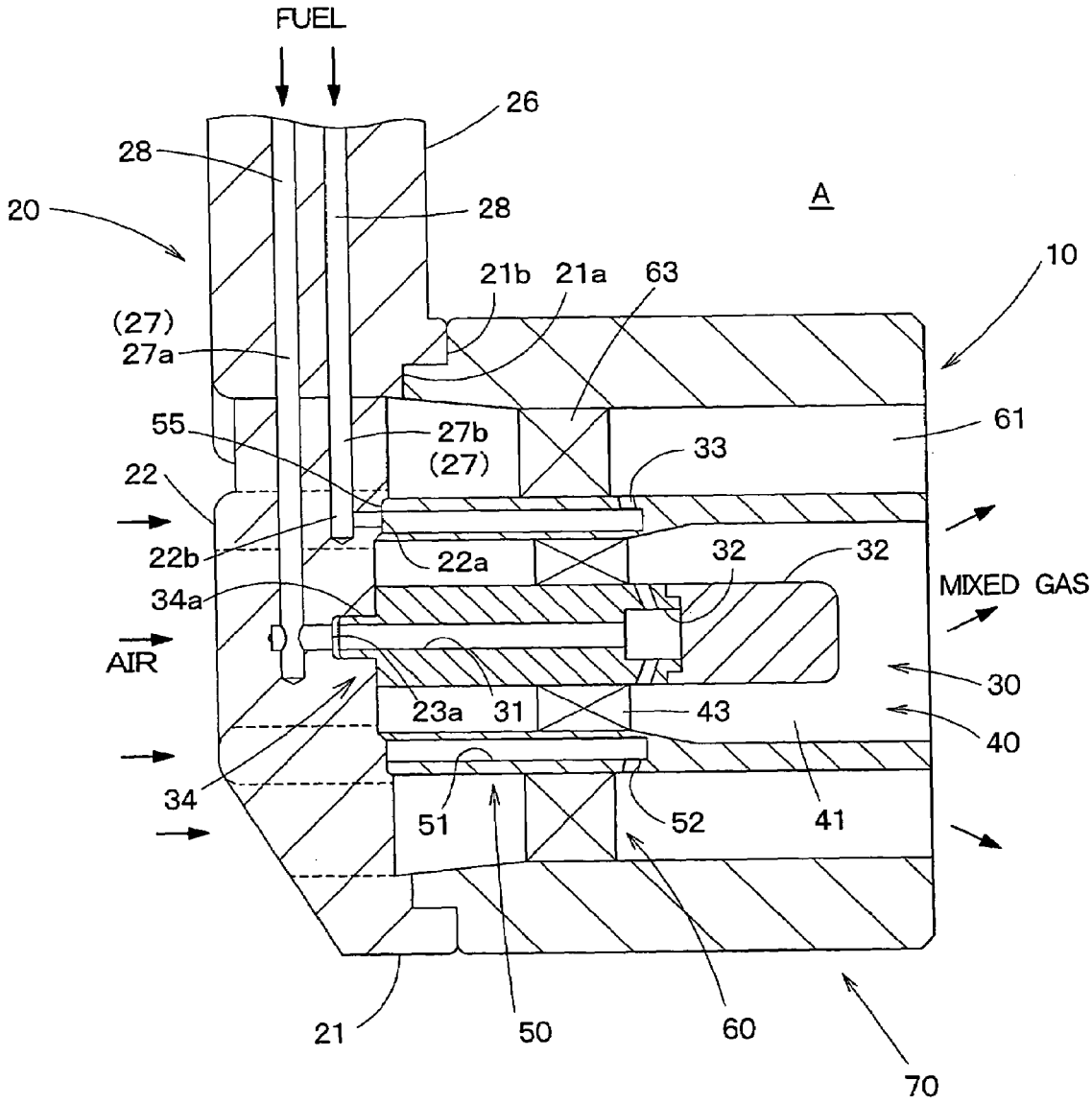
FIG. 1 is a sectional view of a fuel injection device including a fuel supply system in a preferred embodiment according to the present invention.
Figure 2:
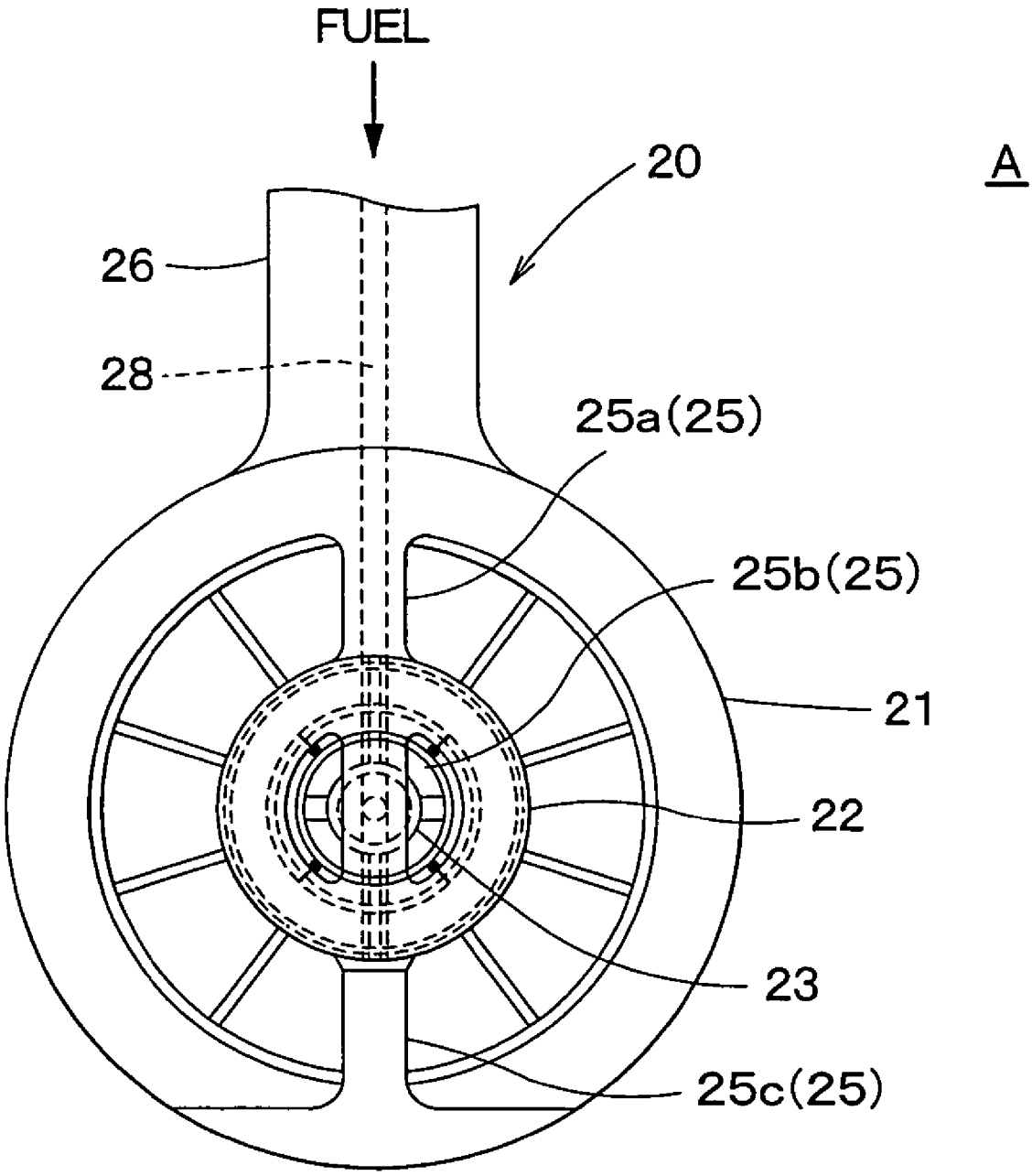
FIG. 2 is a front elevation of the fuel injection device shown in FIG. 1.
Figure 3:
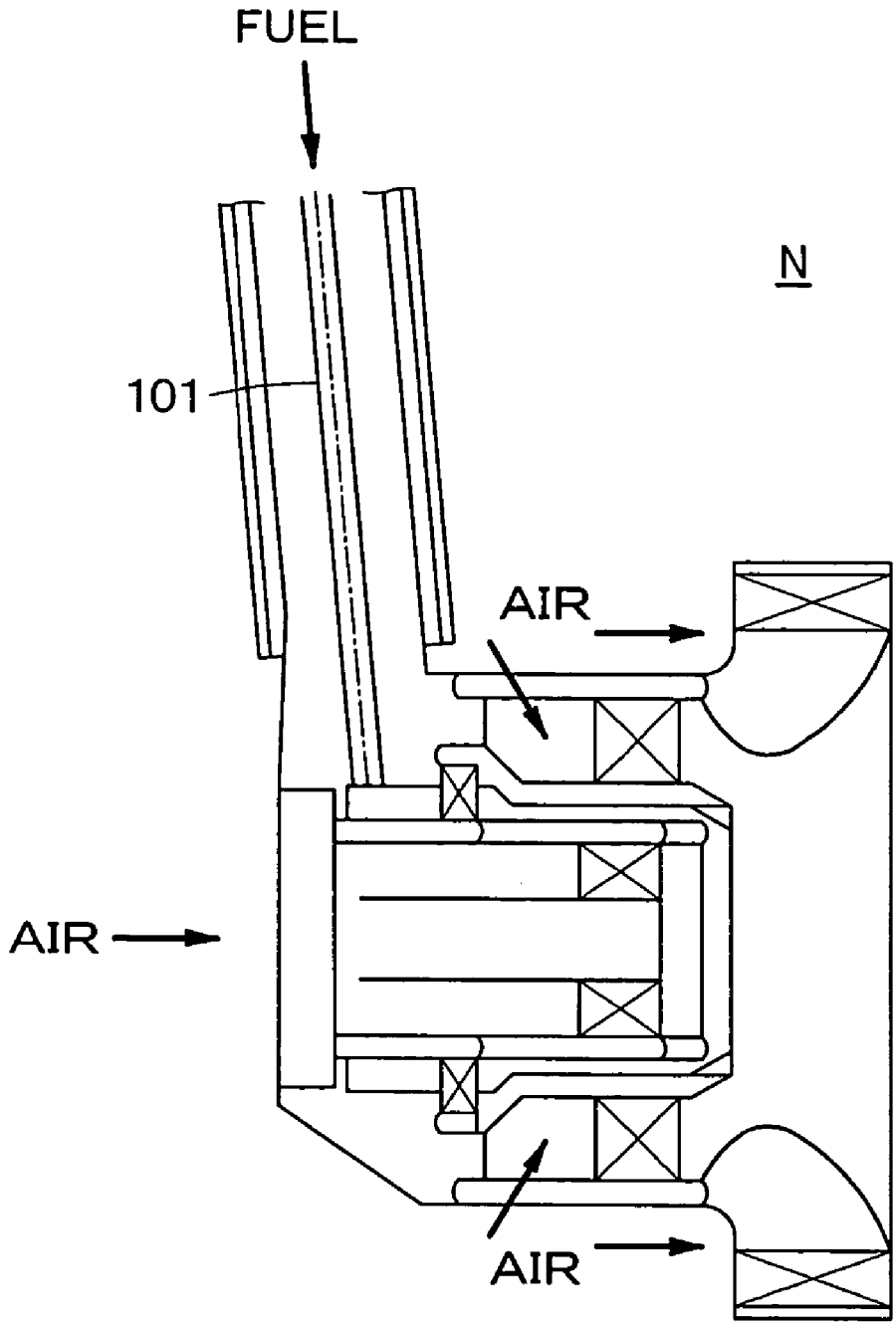
FIG. 3 is a view of a conventional fuel injection nozzle.

FIGS. 1 and 2 show a fuel injection device A for a gas turbine to which a fuel supply method and a fuel supply system in preferred embodiments according to the present invention are applied. The fuel injection device A includes, as principal components, a fuel injection unit 10 that provides a combustion chamber (not shown) with an air fuel mixture, and a holding-and-supplying unit 20 that holds the fuel injection unit 10.

The fuel injection unit 10 includes a first fuel injection member 30 disposed in a central part of the fuel injection unit 10, a first atomizing mechanism 40 surrounding the first fuel injection member 30 and capable of atomizing fuel injected from the first fuel injection member 30, a second fuel injection member 50 surrounding the first atomizing mechanism 40, a second atomizing mechanism 60 surrounding the second fuel injection member 50 and capable of atomizing fuel injected from the second fuel injection member 50, and an outer casing 70 surrounding the second atomizing mechanism 60.

The first fuel injection member 30 has a cylindrical shape and is provided with a fuel supply passage 31 extended coaxially with the first fuel injection member 30 from a base end part to a middle part of the first fuel injection member 30, and a fuel reservoir 32. The fuel reservoir has a side wall provided with a predetermined number of radial fuel jetting holes 33 arranged on a circle. A joining part 34 is formed on the base end part of the first fuel injection member 30.

The joining part 34 is joined to the holding-and-supplying unit 20. A reduced part 34*a* is formed at the base end part of the first fuel injection member 30 as shown in FIG. 1.

The second fuel injection member 50 has the shape of a cylindrical tube and is provided with a fuel reservoir 51. The fuel reservoir 51 has a side wall provided with a predetermined number of radial fuel jetting holes 52 arranged on a circle.

A joining part 55 is formed on the base end part of the second fuel injection member 50. The joining part 55 is joined to the holding-and-supplying unit 20. A projection of a predetermined length is formed in the base end part of the second fuel injection member 50 as shown in FIG. 1.

The first atomizing mechanism 40 has an annular air passage 41 defined by the outer circumference of the first fuel injection member 30 and the inner circumference of the second fuel injection member 50, and an air swirling mechanism 43 disposed between the first fuel injection member 30 and the second fuel injection member 50.

The second atomizing mechanism 60 has an annular air passage 61 defined by the outer circumference of the second fuel injection member 50 and the inner circumference of the outer casing 70, and an air swirling mechanism 63 disposed between the second fuel injection member 50 and the outer casing 70.

As shown in FIGS. 1 and 2, the holding-and-supplying unit 20 has an outer ring 21 joined to the outer casing 70, an inner ring 22 joined to the second fuel injection member 50, a central cylindrical part 23 joined to the first fuel injection member 30, a fuel feed arm 26 formed integrally with the outer ring 21, and a combining structure 25 connecting those components 21, 22, 23 and 26. Fuel passages 28 are formed through the fuel feed arm 26 so as to be connected to fuel passages penetrating a gas turbine casing. Combustion air is supplied through the space between the inner ring 22 and the central cylindrical part 23 to the first atomizing mechanism 40, and combustion air is supplied through the space between the outer ring 21 and the inner ring 22 to the second atomizing mechanism 60.

As shown in FIG. 1, the inner ring 22 is provided with an annular groove 22*a* of a predetermined depth formed in a shape corresponding to that of the base end part of the second fuel injection member 50 in its surface facing the second fuel injection member 50. A fuel supply hole 22*b* is formed in the annular groove 22*a*. A fuel supply passage 27 (second fuel supply passage 27*b*) is formed through the fuel feed arm 26 and the combining structure 25 and is connected to the fuel supply hole 22*b*.

The central cylindrical part 23 is provided with a recess 23*a* of a predetermined depth having a shape corresponding to that of the base end part of the first fuel injection member 30 as shown in FIG. 1. A fuel supply passage 27 (first fuel supply passage 27*a*) formed through the fuel feed arm 26 and the combining structure 25 opens into the bottom of the recess 23*a*.

The combining structure 25 has an upper connecting part 25*a* connecting the inner ring 22 to an upper part of the outer ring 21, a central connecting part 25*b* connecting the inner ring 22 and the central cylindrical part 23, and a lower connecting part 25*c* connecting the inner ring 22 to a lower part of the outer ring 21. The fuel supply passages 27 connected to the fuel supply passages 28 of the fuel feed arm 26 are extended in the combining structure 25. The first fuel supply passage 27*a* and the second fuel supply passage 27*b* formed in the upper connecting part 25*a* and the central connecting part 25*b* are arranged so as to overlap each other with respect to a direction in which combustion air flows as shown in FIG. 1 to form each of the upper connecting part 25*a*, the central connecting part 25*b* and the lower connecting part 25*c* in the least necessary width, i.e., a dimension along the direction perpendicular to the direction in which combustion air flows. Thus, the increase of blockage of the air flowing into combustor and un-uniformity in air flowing into combustor caused by the upper connecting part 25*a*, the central connecting part 25*b* and the lower connecting part 25*c* can be limited to the least unavoidable extent. The words upper and lower are used for designating upper and lower parts as viewed in FIGS. 1 and 2 for convenience and do not necessarily designate upper and lower parts on the combustor of an actual gas turbine.

The fuel injection device A jets fuel only by the first fuel injection member 30, atomizes the jetted fuel by the first atomizing mechanism 40, and supplies an air-fuel mixture into combustion chamber while the gas turbine is operating in low-power settings.

The fuel injection device A jets fuel by both the first fuel injection member 30 and the second fuel injection member 50, atomizes the jetted fuel by the first atomizing mechanism 40 and the second atomizing mechanism 60, and supplies an air-fuel mixture into combustion chamber while the gas turbine is operating in a high-power settings.

In the fuel injecting device A having the fuel supply system in the present embodiment and capable of carrying out the fuel supply method in this embodiment, the fuel supply passages 27 are formed in the holding-and-supplying unit 20 holding the fuel injection unit 10 and are connected to the fuel passages 28 formed in the fuel feed arm 26 combined with the holding-and-supplying unit 20. Therefore, any additional fuel supply pipes are not necessary, and hence the fuel supply system has simple construction. Since any fuel supply pipes are not necessary, the fuel supply system is free from troubles attributable to laying fuel supply pipes. For example, preventive means for preventing the breakage of fuel supply pipes liable to occur in installing a fuel supply system are unnecessary, and hence the fuel supply system can be efficiently assembled. The fuel supply system is free from troubles due to the difference in thermal expansion between fuel supply pipes and a supporting part.

Various modifications of the foregoing fuel supply system are possible. For example, the fuel supply system may be provided with a third fuel injection member surrounding the second fuel injection member 50 in addition to the first fuel injection member 30 and the second fuel injection member 50. When the fuel injection device A is disposed under the annular combustor instead of over the combustor as mentioned above, "upper" and "lower" used in the foregoing description are replaced with "lower" and "upper", respectively.

Although the invention has been described in its preferred embodiment, obviously many changes and variations are possible therein. It is therefore to be understood that the present invention may be practiced otherwise than as specifically described herein without departing from the scope and spirit thereof.

What is claimed is:

1. A fuel supply method for a fuel injection device including a fuel injection unit and a holding-and-supplying unit holding the fuel injection unit, the fuel injection unit including a first fuel injection member, a first atomizing mechanism surrounding the first fuel injection member, an annular second fuel injection unit disposed radially outside the first atomizing mechanism, a second atomizing mechanism disposed radially outside the second fuel injection member, and an annular outer casing surrounding the second atomizing mechanism, comprising:

supplying fuel to the first fuel injection member through a first fuel supply passage internally formed in the holding-and-supplying unit; and supplying fuel to the annular second fuel injection member through a second fuel supply passage internally formed in the holding-and-supplying unit.

2. The fuel supply method according to claim 1, wherein the first fuel supply passage and the second fuel supply passage are arranged so as to overlap each other with respect to a flowing direction of combustion air.

3. A fuel supply system for a fuel injection device including a fuel injection unit and a holding-and-supplying unit holding the fuel injection unit, the fuel injection unit including a first fuel injection member, a first atomizing mechanism surrounding the first fuel injection member, an annular second fuel injection member disposed radially outside the first atomizing mechanism, a second atomizing mechanism disposed radially outside the second fuel injection member, and an annular outer casing surrounding the second atomizing mechanism, wherein the holding-and-supplying unit is internally provided with a first fuel supply passage through which fuel is supplied to the first fuel injection member and a second fuel supply passage through which fuel is supplied to the annular second fuel injection member.

4. The fuel supply system according to claim 3, wherein the first fuel supply passage and the second fuel supply passage are arranged so as to overlap each other with respect to a flowing direction of combustion air.

5. The fuel supply system according to claim 3, wherein the holding-and-supplying unit includes an integral assembly of an outer ring joined to the outer casing, an inner ring joined to the second fuel injection member, a cylindrical part joined to the first fuel injection member, and a fuel feed arm joined to the outer ring, and air passages are formed between the outer ring and the inner ring and between the inner ring and the cylindrical part.

* * * * *